US006407666B1

(12) United States Patent
Debrody et al.

(10) Patent No.: US 6,407,666 B1
(45) Date of Patent: Jun. 18, 2002

(54) ELECTRICAL CONNECTOR FOR A CYLINDRICAL MEMBER

(75) Inventors: Robert Debrody, Wayne, NJ (US); Jeffery Eugene Warner, Fremont, IN (US); Craig B. Hamilton, Waterloo, IN (US); Jeffery Alan Brimmer, Angola, IN (US)

(73) Assignee: Transguard Industries, Inc., Angola, IN (US)

( * ) Notice: Subject to any disclaimer, the term of this patent is extended or adjusted under 35 U.S.C. 154(b) by 0 days.

(21) Appl. No.: 09/902,289

(22) Filed: Jul. 10, 2001

(51) Int. Cl.[7] ..... G08B 13/14

(52) U.S. Cl. ..... 340/568.4; 340/568.1; 340/542; 70/38 B

(58) Field of Search ..... 340/568.1, 541, 340/568.4, 571, 542, 539, 540; 174/84 R, 260, 261; 70/38 A, 38 B

(56) References Cited

U.S. PATENT DOCUMENTS

| | | | | |
|---|---|---|---|---|
| 1,697,954 A | | 1/1929 | Gribbie | |
| 2,321,158 A | | 6/1943 | Rees | |
| 2,342,170 A | | 2/1944 | Tinnerman | |
| 2,342,312 A | | 2/1944 | Tinnerman | |
| 2,394,728 A | | 2/1946 | Tinnerman | |
| 3,275,736 A | | 9/1966 | Hotine et al. | |
| 3,745,513 A | | 7/1973 | Gross | |
| 4,295,184 A | * | 10/1981 | Roberts | 361/406 |
| 5,587,702 A | * | 12/1996 | Chadfield | 340/542 |
| 5,980,270 A | * | 11/1999 | Fjelstad | 439/71 |

* cited by examiner

*Primary Examiner*—Anh La
(74) *Attorney, Agent, or Firm*—Carella Byrne Bain Gilfillan Cecchi et al; John G. Gilfillan, III; William Squire

(57) ABSTRACT

An electrical connector is for use with a cylindrical member having an electrically conductive coating which can be damaged. The connector comprises a steel stamped ring with a terminal extending from the ring. Three like contacts overly the central opening of the ring and are bent for abutting the received cylindrical member in resilient sliding ohmic engagement regardless of the insertion or withdrawal direction of the member without destructive damage to the member coating. The contacts are relatively stiff to provide vibration resistant engagement with the member. The ring is supported in a slot in a housing to further stiffen the connector and the contact engagement with the member which completes a circuit which if broken is sensed and transmitted as a tampered condition.

22 Claims, 4 Drawing Sheets

FIG. 10
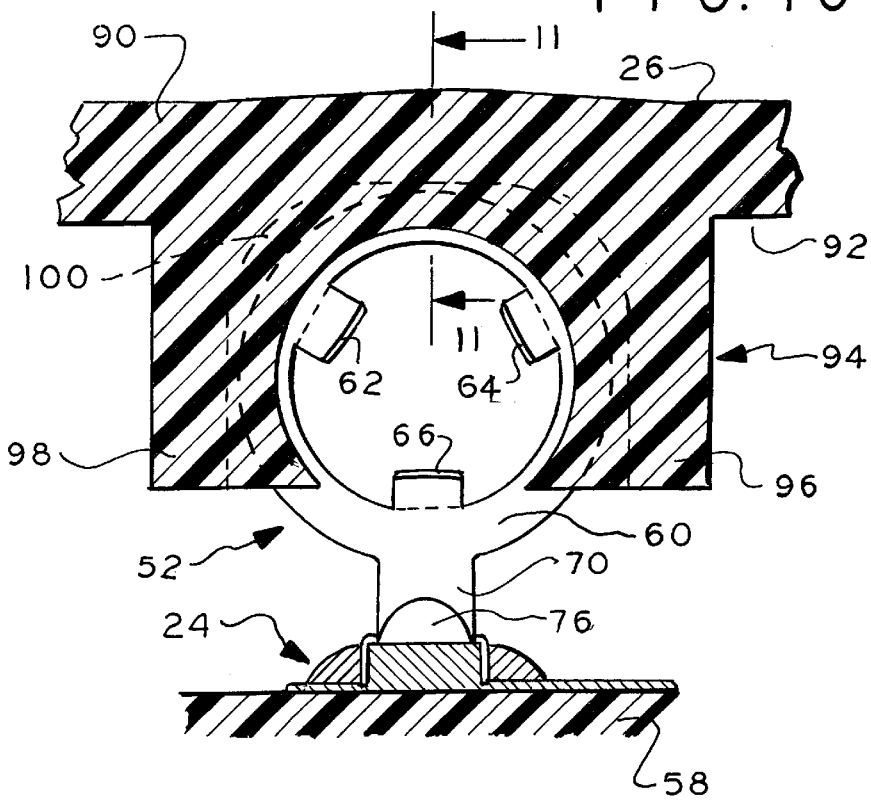
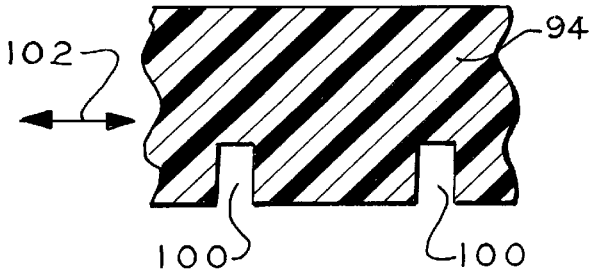
FIG. 11
FIG. 12
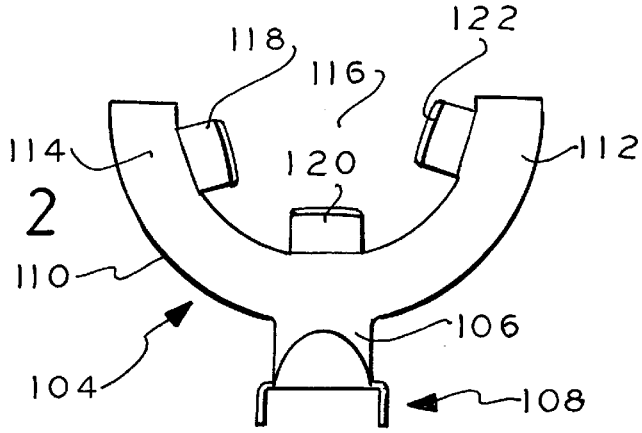

ELECTRICAL CONNECTOR FOR A CYLINDRICAL MEMBER

CROSS REFERENCE TO RELATED APPLICATION

Of interest is commonly owned U.S. patent application Ser. No. 09/293,135 entitled Electronic Security Seal filed Apr. 16, 1999 in the name of Terrence N. Brammall et al. incorporated by reference herein in its entirety.

This invention relates to electrical connectors, and more particularly, connectors for electrically connecting a cylindrical member, such as a bolt, a rod, a cable, screw or stud, to a circuit, e.g., electronic seal locking devices.

Cargo shipping vehicles, cargo shipping containers and rail cars are subject to widespread tampering due to the value of the cargo. The rail cars, vehicles and containers have doors which are locked shut with hasps and secured with locking seals. Such seals include a steel bolt having a head and shank which is attached to a locking body having a shank locking mechanism. When the shank is inserted into the body, a locking collet or other arrangement permanently locks the shank to the body. For example, reference is made to commonly owned U.S. Pat. Nos. 5,005,883, 5,127,687, 4,802,700, 5,347,689, 5,413,393 and others for the disclosure of various seals of the type described.

Cargo containers are shipped via boat, train and truck. Hundreds of containers may be on a single boat. When the containers are unloaded they may be subject to tampering and vandalism. It is important that such tampering be immediately noted to preclude theft of valuable cargo. To assist in such theft and tampering prevention, prior art seals are assigned serial numbers. These seals are then assigned to a container and lock the assigned container. The serial number, container number, the carrier, and the location are then entered into a local computer manually. The entry then is manually made to show that the container is being shipped out of that location. Should a seal be tampered with, the event may be discovered at a different time and different location.

An electronic tagging device is commercially available that is programmable and which transmits information that is programmed, such as tagging identification serial numbers and other information as desired. This information is transmitted via radio frequency and is referred to as radio frequency identification (RFID) which is well known in the art. The aforementioned copending application discloses an embodiment of such a seal. However, the seal disclosed in that application comprises a plurality of contacts for engagement with the bolt, each contact at one contact point on the bolt and which contacts complete the circuit in the seal. The seal becomes electrically operative after the bolt is inserted and locked to the seal.

In that embodiment, a problem was encountered in which the contacts periodically would become disengaged from the bolt causing the generation of false tampering signals. Those contacts are S-shaped and spring loaded so that when compressed the contact resiliently engages the bolt. Still such a contact was found not satisfactory due to intermittent engagement due to vibrations and the like during use.

The present inventors recognize a need for a contact that solves the above identified problem with the prior art contacts previously used in such electronic seals.

U.S. Pat. No. 1,697,954 discloses an electrical connector having an aperture for accommodating a bolt. The connector may have external or internal teeth. The teeth are warped.

The teeth prevent the backing off of a binding nut attached to the bolt. The teeth dig into the metal when the nut is tightened to improve the electrical contact. The nut when tightened stresses the teeth and flattens them. The effect is the same whether the teeth are radially inward or outward, with the inward direction preferred to save metal. This connector is not useful with a bolt used for seals which must engage the electrical connector without a nut. The patent does not describe the teeth as engaging the bolt for electrical contact with the bolt without the presence of a nut. The bolt thus can not engage the connector electrically without the use of a nut which is not desirable in an electronic seal of the type described above. This connector is not useful for such a seal and coupled bolt.

U.S. Pat. No. 2,321,158 discloses a connector telescopically associated with a stud to secure the stud against axial movement with respect to an associated workpiece and also to serve as an electrical terminal. Inner teeth are forced into engagement with the stud with a tool and by application of a force on the outer margin of the connector with a tool the teeth may be released. This connector is not useful for a seal of the type disclosed as it requires access to the connector margin to release the connector and also, such release is not desirable after the bolt is locked. The contact in the electronic seal described above herein is located inside of the seal housing and access to the contact is not possible with engagement or disengagement tools once the locking bolt is locked to the housing. Such access is not desirable as it would permit access to tampering tools inside of the seal housing. Further, a fastening tool is required by the patent to embed the connector teeth into the stud. To loosen the connector requires pressure at the outer edges of the of the rim of the connector with a tool. This connector is not operative with the electronic seal of the type described above herein.

U.S. Pat. Nos. 2,342,170, 2,342,312 and 2,394,728 to Tinnerman disclose fastening devices designed to serve as a nut for use with a threaded screw. The devices comprise a sheet metal spring plate member designed for use with a threaded bolt or screw to provide relatively quick fastening to the bolt or screw. The devices are currently well known in industry as Tinnerman fasteners. These devices are not known as electrical connectors and are not normally used as such. The devices have thread engaging means for engaging the threads of the bolt or screw. These devices are not described as or designed for use with a non-threaded bolt, but rather are used to fasten parts together. Each device requires threads on the bolt so that the plate member can engage the threads. The patent does not describe the device as being releaseably attachable to a non-threaded bolt of the type used with electronic seals of the type described hereinabove as an electrical connector. Further, the use of a threaded bolt is not desirable in a locking seal of the type described herein as such threads would permit the bolt to be readily disengaged and defeat the purpose of the seal which is to provide permanent locking engagement with the bolt and tamper evidence should the seal be opened.

U.S. Pat. No. 3,275,736 discloses interconnecting elements for use with electronic components. The disclosed elements employ thin conducting material provided with spring fingered openings fitting over and locking on to component lead wires. After the circuit is mechanically locked to the wires, the points of the spring fingers may be welded to the wires. However, the pointed ends of the fingers prevent the member from pulling off the leads because the pointed ends of the fingers dig into the leads. Thereafter, a resistance weld is formed at the pointed ends between the leads and the fingers. This device is not useful with the above described seal.

U.S. Pat. No. 3,745,513 discloses a strain relieving electrical connector. The connector has two loops each of which is soldered to a respective printed circuit board and to a component lead. The two loops are connected by a flexible member which minimizes force applied to the solder joints under dynamic loading conditions. One loop has a serrated opening. The point like tips of the serrations are biased into the component lead preventing the loop 16 from backing off from the lead. Such prevention is not desired in an electronic seal.

In the aforementioned copending application Ser. No. 09/293,135, an electronic security seal is disclosed for use with a bolt. The bolt is steel and has a head at one end of a shank. An insulated coating is over the shank except for the head and the end portion opposite the head which are bare. An electrically conductive coating covers the insulation and the head excluding the bare end. The electrically conductive coating forms a single conductor with the underlying metal bolt between the bolt head and the bare bolt end distal the head. The bare bolt end forms a first terminal and the electrically conductive coating at a region spaced from the bare end forms a second terminal. A protective second insulating coating is over the electrically conductive coating. First and second electrically conductive spring metal contacts in the disclosed seal are in ohmic contact with the respective first and second terminals forming a circuit therewith.

In use, the bolt is inserted into the seal housing along the bolt longitudinal axis and locked to the seal by a locking mechanism. As a result, the bolt makes sliding engagement with the contacts as the bolt is inserted into the housing. Presently, the disclosed contacts in that application are S-shaped and make sliding engagement with the bolt terminals at one tangential side of the bolt. This contact arrangement is not satisfactory as vibrations may cause intermittent engagement of the contacts with the bolt, which intermittent engagement may cause the seal to erroneously transmit a false tamper condition due to the break in the circuit.

None of the disclosed connectors described in the above prior art patents are useful with a cylindrical member and electronic seal of the type described herein. They either require threads or have points or edges which serve as a one way clutch by digging into the mating bolt, stud or screw. This digging prevents the mating component from backing off the bolt, stud or screw once inserted. Such digging is not permitted with a bolt or cylindrical coated member of the type described above for use in the seal of the aforementioned patent application. Such digging will destroy the integrity of the connection to the coating forming the second terminal and may ohmically engage the underlying bolt forming the first terminal.

A need is seen for an electrical connector for use with a cylindrical member in an electronic seal wherein the member has an electrically conductive coating forming a terminal. A need is seen for an electrical connector which will overcome the intermittent problems of prior art contacts and yet not damage the terminals on the coated member in the manner described.

A connector according to the present invention is for electrical connection to a cylindrical metal member having at least one electrical terminal surface and a longitudinal axis. The connector comprises a metal element having an opening for receiving the member therethrough. At least one resilient electrical contact extends from the element and overlies the opening, the member for passing through the opening in an insertion direction along the axis. The member at least one electrical terminal surface is for slidable releasable ohmic engagement with the at least one resilient electrical contact with negligible damage to the at least one electrical terminal surface. An electrical terminal is connected to the element.

In one aspect, a plurality of the at least one electrical contact extend from the element in an array about the opening. Preferably the contacts are identical.

In a further aspect, the at least one contact has a bent curved portion for slideably ohmically engaging a received bolt surface in two opposing directions.

Preferably the at least one contact and terminal are sheet metal one piece and integral with the element.

In a further aspect, the at least one contact extends from the element from a linear junction with the element to permit bending of the at least one contact adjacent to the junction.

In a further aspect, an array of at least three of the at least one contact are arranged about the opening.

In a further aspect, the element is planar, the terminal comprising one piece integral sheet metal with the element, the terminal comprising an L-shaped member with a first leg extending radially away from and coplanar with the element and a second leg extending from the first leg at a right angle to the first leg, a depression in the two legs forming a reinforcement rib to stiffen the second leg relative to the first leg.

In a further aspect, at least one terminal tab extends from the second leg normal to the second leg in a direction away from the element.

In a further aspect, the element is a sheet metal ring.

In a further aspect the element is a U-shaped yoke.

In a still further aspect, an electronic seal according to the present invention comprises an electrically operated seal device including an electrical connector and a circuit coupled to the connector for generating signals manifesting a seal tampered state and a seal closed locked state. A cylindrical member is included and includes electrically conductive means, the member for locking engagement with the device to place the device in the locked state, the electrically conductive means for causing the circuit to be energized for generating the signals after the member is placed in the locked state, the electrically conductive means when opened for opening the circuit to cause the circuit to generate the tampered state, the electrically conductive means when damaged making the circuit inoperative.

The electrical connector electrically connects the cylindrical member to the circuit in the locked state. The connector comprises at least one metal element having an opening for receiving the cylindrical member therethrough. At least one electrical contact extends from the at least one element and overlies the opening for resiliently slidably receiving the cylindrical member extending through the opening and for slidable releasable engagement with the member in the member insertion engaging direction with negligible damage to the electrically conductive means. An electrical terminal is connected to the element, the at least one contact and the terminal for connection to the circuit to enable the causing.

IN THE DRAWING:

FIG. 10 is an end elevation view partially in section showing a connector of FIG. 2 engaged with the seal housing without the bolt present;

FIG. 11 is an elevation sectional view of the seal housing of FIG. 10 without the connector attached showing slots in the housing for receiving portions of the connector; and FIG. 12 is an elevation view of an electrical connector according to a second embodiment of the present invention.

Figure 1:
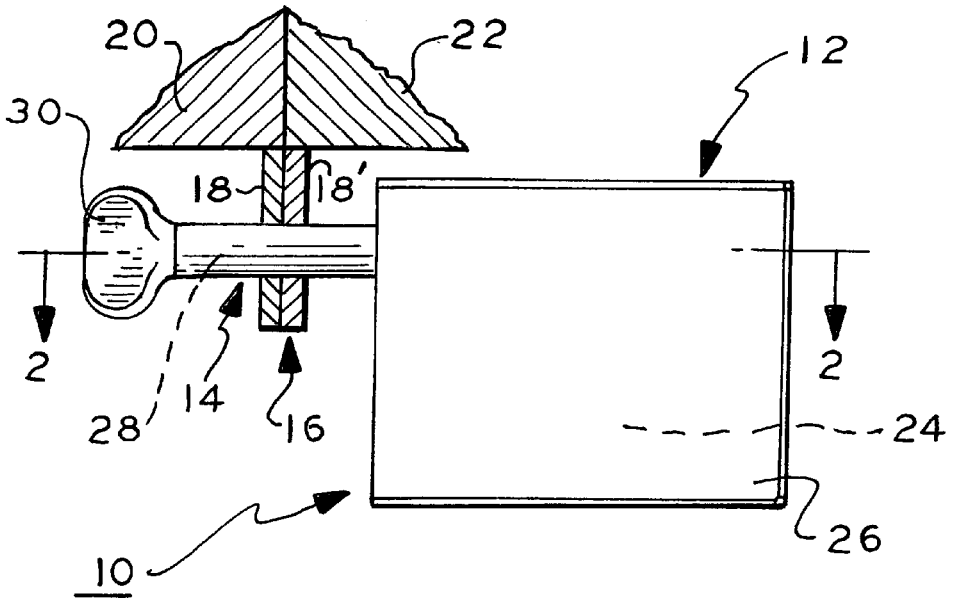
FIG. 1 is a side elevation partially in section view of an electronic seal assembly including a connector according to an embodiment of the present invention.

In FIG. 1, electronic seal assembly 10 comprises an electronic seal 12 and a bolt 14, preferably steel, locked to the seal 12. The bolt 14 is attached to hasp 16 to lock the two hasp elements 18, 18' together, the element 18 being attached to a door 20 and the element 18' being attached to a door or other support structure 22. Seal 12 and its electrical circuit may be constructed as described in the aforementioned copending application Ser. No. 09/293,135 incorporated by reference herein. The primary and significant difference between that prior seal and the seal 12 is the construction of the seal housing 26, FIGS. 1 and 2, and the electrical connectors for ohmically connecting the bolt to the circuit 24, FIGS. 3 and 4, of the seal 12 of the present invention. The bolt 14 is preferred for this embodiment, but in other implementations of electronic seals, the bolt may be replaced by a solid cylindrical metal member such as a threaded rod, a stranded cable, a screw, a stud or a wire. The member does not have to be circular cylindrical but this is preferred. The member could be a polygon, elliptical or other geometric shapes in section.

Figure 3:
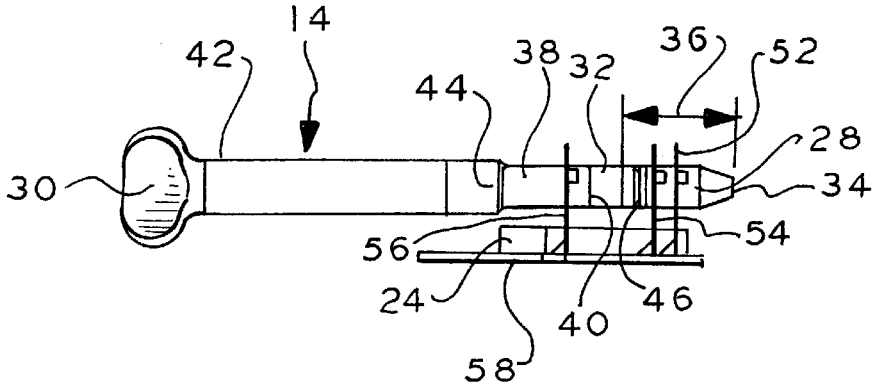
FIG. 3 is a side elevation view of the bolt of FIG. 2 attached to the printed circuit board assembly of FIG. 2 according to an embodiment of the present invention.

The bolt 14 has a steel core 28, FIG. 3, terminating at one end with a head 30. The bolt 14, FIG. 3, core 28 has an electrically insulating coating 32 spaced from bolt end 34 a distance 36 and extending to the head end over the entire remaining portion of the bolt shank excluding the head 30. The metal surface of the core 28 is thus exposed over distance 36. An electrically conductive coating 38 is over all of coating 32 except the bolt region between edge 40 and end 34. The electrically conductive coating 38 is also over the head, and since the head is not coated with the insulating coating 32, the coating 38 is ohmically connected to the bolt metal surface of the core 28 forming an electrical conductor with the core 28 along the bolt longitudinal axis. A second outer electrically insulting coating 42 is over the head 30 and a portion of the electrical coating 38 terminating at edge 44. Thus the core at region 36 forms one electrical terminal of the bolt electrical conductor formed by the core 28 and the electrical conductive coating 38. The electrically conductive coating 38 between edges 40 and 44 forms a second terminal of the bolt electrical conductor.

Figure 2:
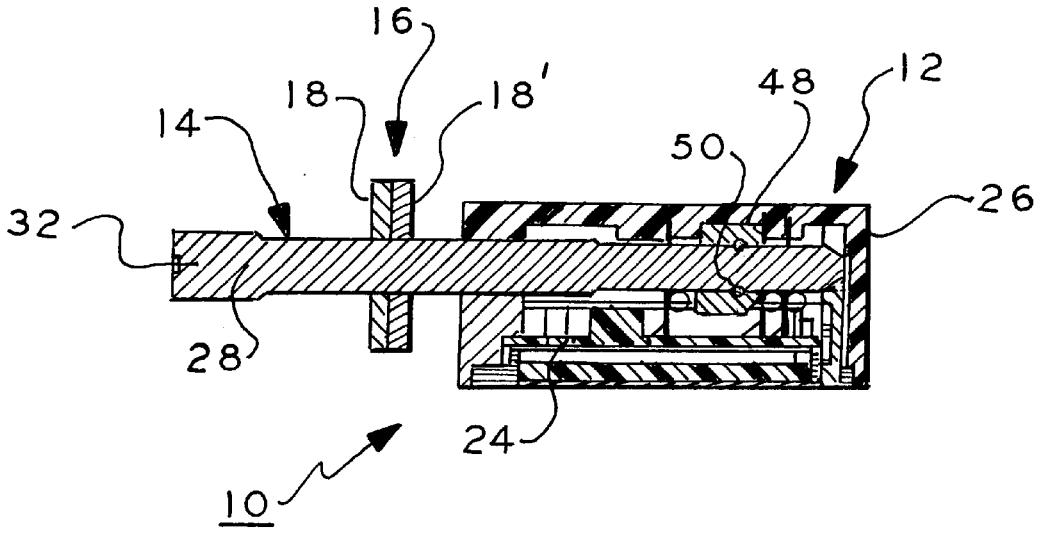
FIG. 2 is a sectional view of the assembly of FIG. 1 taken along lines 2—2 showing a locking bolt locked to the electronic seal of the assembly.

The bolt 14 also has a locking groove 46 for engaging a bolt locking mechanism 48, FIG. 2. The mechanism 48, for example, as described in U.S. Pat. No. 4,802,700 by way of example and incorporated by reference herein, comprises a lock body having a steel hollow housing with an open core and a tapered annular groove in the housing core in which an annular spring 50 engages. The housing groove is tapered so that the spring can expand in one axial position to permit the bolt to be inserted in the insertion direction. The groove is narrowed in a withdrawal direction to preclude such expansion of the spring. The spring engages the groove 46 in the bolt to lock the bolt in the housing 12 interior in the withdrawal direction. The bolt and mating lock mechanism is described in further detail and with other embodiments in the aforementioned copending application Ser. No. 09/293,135 incorporated by reference herein.

Figure 4:
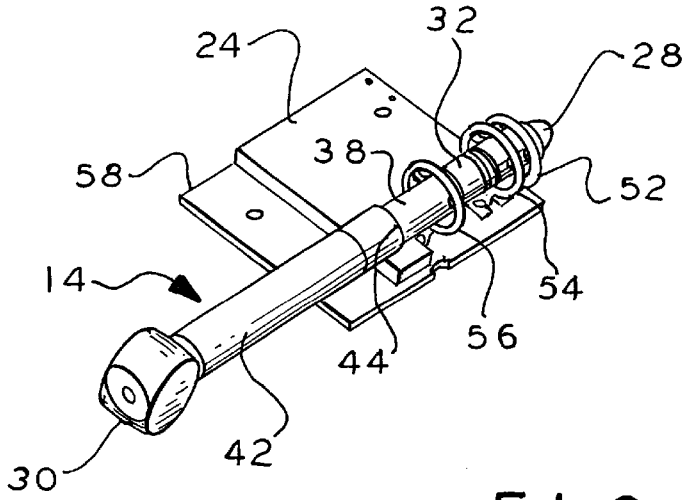
FIG. 4 is an isometric view of the bolt and printed circuit board assembly of FIG. 3.

In FIGS. 3 and 4, three identical electrical connectors 52, 54 and 56 are soldered to corresponding conductors in the circuit 24 mounted on printed circuit board 58. Connectors 52 and 54 make ohmic contact with the metal exposed bolt core 28 forming one bolt terminal in the region of distance 36. The remaining connector 56 makes ohmic contact with the exposed electrically conductive coating 38 which forms the second terminal of the bolt 14.

Figure 5:
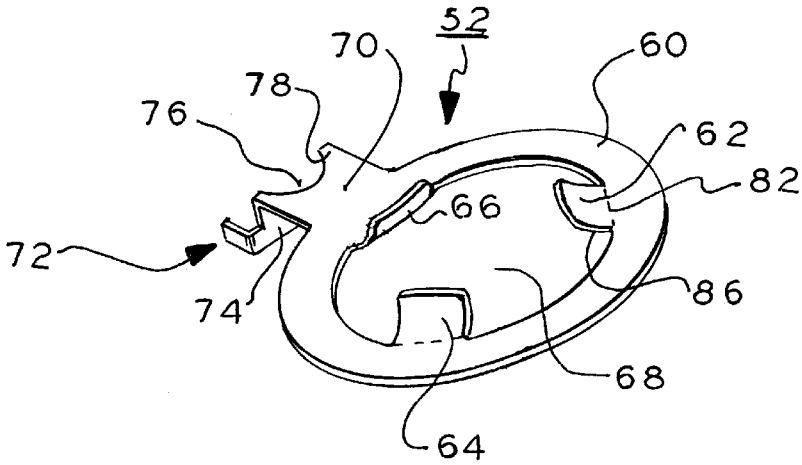
FIG. 5 is an isometric view of the electrical connector used in the embodiments of FIGS. 3 and 4.
Figure 6:
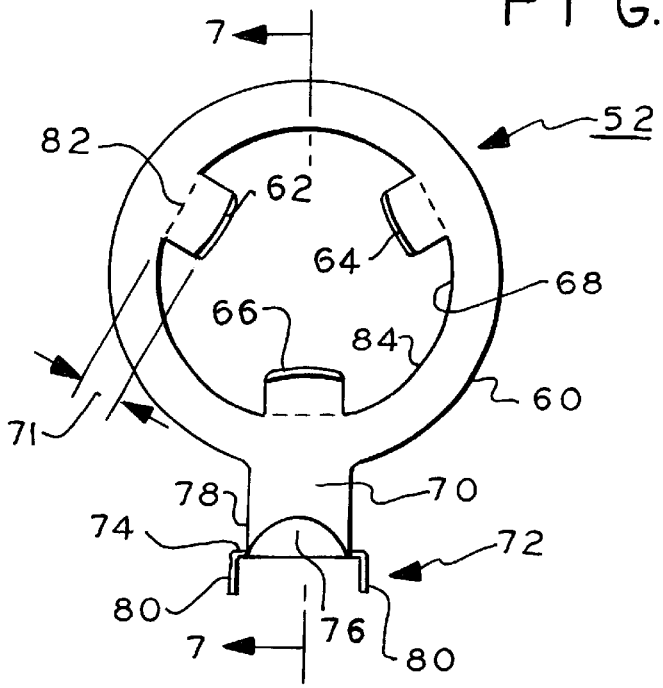
FIG. 6 is a top plan view of the connector of FIG. 5.
Figure 7:
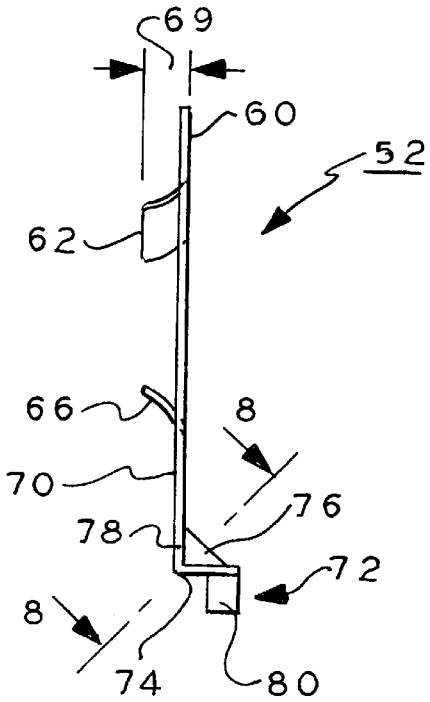
FIG. 7 is a side elevation sectional view of the connector of FIG. 6 taken along lines 7—7.

In FIGS. 5, 6 and 7, representative connector 52 will be described. Connector 52 preferably is formed from heat treated stamped sheet 1050 spring steel preferably about 0.25 mm (0.01 inches) thick and may be plated with a protective coating of tin. The connector may also be formed of beryllium copper or other spring metals. Connector 52 comprises a ring 60 from which three contacts 62, 64 and 66 are cantilevered juxtaposed with opening 68 formed by the ring 60. The contacts preferably extend into the opening 68 of the ring a distance 71 (FIG. 6), which may be about 2 mm. The ring 60 opening 68 has a diameter of preferably about 12 mm (0.475 inches) in this embodiment. The ring 60 may have a diameter of preferably about 16 mm (0.625 inches). The connector 52 includes an extension 70 extending radially from and coplanar with the ring 60. A terminal 72 extends from the end of extension 70 distal the ring 60.

Figure 8:
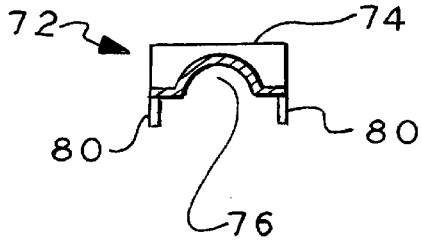
FIG. 8 is a sectional view of the connector of FIG. 7 taken along lines 8—8.

In FIGS. 7 and 8, the terminal 72 comprises a leg 74 depending at a right angle to the extension 70. A U-shaped depression 76 is formed in the leg 74 and leg 78 formed by the distal end of the extension 70. Depression 76 is at about 45° to the plane of legs 74 and 78. The depression 76 forms a reinforcing rib for the legs 74 and 78 and serves to stiffen the leg 74 and make leg 74 relatively rigid with respect to the leg 78. The rib formed by depression 76 stiffens the upright position of the ring 60 on the circuit board 58.

A pair of spaced tabs 80 depend from leg 74 in a radial direction away from ring 60 parallel to the plane of the ring 60. The tabs 80 define parallel planes normal to the legs 74 and 78. The leg 74 and tabs 80 form a support and terminal for solder attachment to a mating terminal (not shown) for ohmic connection with the printed circuit board 58 circuit 24, FIGS. 3 and 4. The tabs may be inserted into mating apertures in the printed circuit board on which the connector is mounted. In the alternative, one tab may be utilized. In both cases, the tab or tabs may be used to attach wire to the connector by crimping the tab(s) to the wire.

The contacts 62, 64 and 66 are preferably identical and are spaced equally about the ring 60 extending radially inwardly overlying the opening 68. In FIG. 6, representative contact 62 will be described wherein contact 62 is formed from a common sheet metal material as the ring. The contact 62 is bent from the ring 60 at a bend line 82. Line 82 is relatively straight so that the contact 62 may bend from the plane of ring 60 commencing from this line. If the bend line 82 were arcuate as is the inner edge 84 then the compound curvatures of edge 84 and the bend direction of the contact 62 in a plane normal to the curvature of edge 84 would tend to stiffen the contact and make it more resistive to bending. Therefore, to increase the resiliency of the contact 62 relative to the ring 60 plane, it is preferred that the contact bend from the ring 60 at a straight bend line 82 rather then a curved bend line that might otherwise be present.

Figure 9:
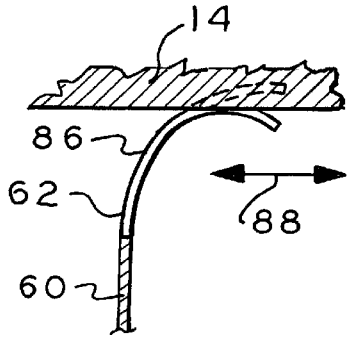
FIG. 9 is a side elevation sectional view of the engagement of a contact of the connector of FIG. 4 with the bolt.

Contact 62 has a curved portion 86 that is cantilevered from the ring 60 and extends away from the plane of the ring 60 juxtaposed with the opening 68. In FIG. 7, the contact 62 extends from the plane of the ring 60 preferably a distance 69 of about 1.7 mm (0.067 inches) in this embodiment. As best seen in FIG. 9, the bolt 14 slideably engages the contact 62 in directions 88. The bolt can displace in either of directions 88 in sliding relation with the contact 62. When the bolt 14 engages the contact 62, the contact 62 bends due to the interference between it and the bolt in the plane of the bolt surface. The dashed line in FIG. 9 shows the contact 62 prior to engagement with the bolt.

By so arranging the three contacts 62, 64 and 66, which are resilient but relatively stiff, an electrically conductive relation always is present between the ring 60 and the bolt 14 in the presence of vibrations and the like as compared to the use of a single resilient contact as described in the aforementioned copending application noted in the introductory portion. Contacts 62, 64 and 66 are relatively stiff and make good electrical contact with the bolt. The stiffness of the contacts precludes temporary disengagement in the presence of vibrations and shock loads. This stiffness of the connector 52 contact engagement with the bolt may be optionally enhanced by supporting the ring 60 in the housing about the ring periphery. This is shown in FIG. 10 in which housing 26 of the seal 12 has an outer wall 90. Wall 90 defines a housing chamber 92. A U-shaped member 94 depends from wall 90 in chamber 92. Member 94 has two legs 96, 98 depending from wall 90. A U-shaped slot 100 is formed in the member 94 legs and adjacent portion of wall 90 which may be thicker in the region between the legs 96 and 98 as shown. The slot 100 may be semi-circular, rectangular or other shape as desired. The slot 100 has a thickness sufficient to receive the ring 60 in a manner to support the ring and preclude bending of the ring 60 in directions 88 (FIG. 9) in and out of the plane of the figure, FIG. 10. The member 94 has a length normal to the plane of the drawing FIG. 10 an amount sufficient to have three spaced slots therein such as slot 100.

In FIG. 11, member 94 is shown with two slots 100. Each slot receives a different one of the connectors 52, 54 and 56, FIG. 4. In the alternative, one member 94 with two slots 100, FIG. 11, can be provided for the connectors 52 and 54. A separate member (not shown) can be provided to receive connector 56.

In any case, because the connector ring 60 is supported in the axial direction of insertion of the bolt 14, FIGS. 3 and 4, directions 102, FIG. 11, the contacts 62, 64 and 66 are relatively stiff and provide good ohmic contact to the bolt 14 when bent by the engagement with the bolt. These contacts are substantially vibration resistant so that the bolt is always electrically coupled in circuit. Even if one or two of the contacts disengage from the bolt, it is highly unlikely the third contact will disengage since a displacement of the bolt away from two of the contacts will result in the bolt displacing toward the third contact in the presence of vibrations. The third contact will provide uninterrupted electrical continuity in the circuit 24. This is important because the accompanying circuit 24 is arranged to sense and transmit the locked state of the bolt, once the circuit is activated by a received locked bolt by electrical continuity of the contacts and bolt. If the circuit is broken by intermittent electrical engagement of the contacts with the bolt, an erroneous tamper condition will be sensed and transmitted. This is not desirable. Therefore, the ohmic engagement of the contacts can not be broken once the circuit is active manifesting the locked state.

A further embodiment of a connector 104 is shown in FIG. 12. Extension 106 and terminal 108 may be the same as in connectors 52, 54 and 56 described above herein. A yoke 110 is connected to the extension in a manner similar to the relationship of the extension 70 to the ring 60, FIGS. 5 and 6. The connector 104 is made of the same material as the connector 52. The yoke 110 is U-shaped and has two arms 112 and 114 defining a central opening 116. Three contacts 118, 120 and 122 extend radially inward from the yoke overlying the opening 116. These contacts are the same in construction as the contacts in the embodiment of FIG. 6.

The housing (not shown) has a member with a slot for receiving the yoke 104 arms 112 and 114. The housing is also constructed with a channel (not shown) to receive the bolt and force the bolt into engagement with the contacts 118, 120 and 122 in a manner to bend the contacts in interference fit therewith. The contacts provide relatively stiff ohmic engagement with the bolt to provide reliable connection thereto.

Preferably, the contacts of the array of three connectors are axially aligned in directions 88, FIG. 9, but this alignment is not critical. The openings of the three connectors however are axially aligned so that a received bolt applies a uniform deflection to all of the contacts.

It will occur to one of ordinary skill that various modifications may be made to the disclosed embodiments. Such embodiments are given by way of illustration and not limitation. It is intended that the scope of the invention be defined by the appended claims.

What is claimed is:

1. A connector for electrical connection to a cylindrical metal member having at least one electrical terminal surface and a longitudinal axis comprising:

a metal element having an opening for receiving the member therethrough;

at least one resilient electrical contact extending from the element and overlying said opening, the member for passing through the opening in an insertion direction along said axis, the member at least one electrical terminal surface for slidable releasable ohmic engagement with the at least one resilient electrical contact with negligible damage to said at least one electrical terminal surface; and an electrical terminal connected to the element.

2. The connector of claim 1 including a plurality of said at least one electrical contact extending from the element in an array about said opening.

3. The connector of claim 2 wherein the contacts are identical.

4. The connector of claim 1 wherein the at least one contact has a bent curved portion for slideably ohmically engaging a received terminal surface in two opposing directions with said negligible damage.

5. The connector of claim 1 wherein the at least one contact and terminal are sheet metal one piece and integral with the element.

6. The connector of claim 1 wherein the at least one contact extends from the element from a linear junction with the element to permit bending of the at least one contact adjacent to the junction.

7. The connector of claim 2 including an array of at least three of said at least one contact arranged symmetrically about the opening.

8. The connector of claim 1 wherein the element is planar, the terminal comprising one piece integral sheet metal with the element, the terminal comprising an L-shaped member with a first leg extending radially away from and coplanar with the element and a second leg extending from the first leg at a right angle to the first leg, a depression in the two legs forming a reinforcement rib to stiffen the second leg relative to the first leg.

9. The connector of claim 8 including at least one terminal tab extending from the second leg normal to the second leg in a radial direction away from the element.

10. The connector of claim 1 wherein the element is a sheet metal ring.

11. The connector of claim 1 wherein the element is U-shaped in the form of a yoke.

12. An electronic seal comprising:

an electrically operated seal device including an electrical connector and a circuit coupled to the connector for generating signals manifesting a seal tampered state and a seal closed locked state; and a cylindrical member including electrically conductive means, the member for locking engagement with the device to place the device in the locked state, the electrically conductive means for causing the circuit to be energized for generating said signals after the member is placed in said locked state, said electrically conductive means when severed for opening the circuit to cause the circuit to generate said tampered state, the electrically conductive means when damaged for making the circuit inoperative;

the electrical connector for electrically connecting the cylindrical member to the circuit in the locked state, the connector comprising:

at least one metal element having an opening for receiving the cylindrical member therethrough;

at least one electrical contact extending from the at least one element and overlying said opening for resiliently slidably receiving the cylindrical member extending through the opening and for slidable releasable engagement with the member in the member insertion engaging direction with negligible damage to said electrically conductive means; and an electrical terminal connected to the element, said at least one contact and said terminal for connection to said circuit to enable said causing.

13. The seal of claim 12 including a linear array of a plurality of said element, each element for ohmically engaging the cylindrical member to complete said circuit.

14. The seal of claim 13 wherein said terminals are each connected to said circuit.

15. The seal of claim 13 wherein the elements each have a plurality of said at least one contact, the plurality of said at least one contact of each element all extending from its corresponding element axially aligned.

16. The seal of claim 15 wherein the plurality of said at least one contact of each element extend from its corresponding element in the same axial direction.

17. The seal of claim 12 wherein said device includes a housing, the cylindrical member being received in the device in an axial direction, said housing including a slot extending transversely the axial direction for receiving and securing at least a portion of said element in said transverse direction.

18. The seal of claim 17 including a plurality of said element aligned in an axial array, said housing including a plurality of said slot, each slot of the plurality for receiving a different one of the elements in said array.

19. The seal of claim 17 wherein the housing includes a U-shaped member having said slot for receiving in said slot a portion of said element distal said terminal.

20. The seal of claim 12 wherein said element is a sheet metal ring.

21. The seal of claim 12 wherein the element is a U-shaped yoke.

22. The seal of claim 12 wherein the contact is arranged for engaging the cylindrical member in two opposing directions with said negligible damage.

* * * * *